US005437308A

United States Patent [19]

Morin et al.

[11] Patent Number: 5,437,308

[45] Date of Patent: Aug. 1, 1995

[54] DEVICE FOR REMOTELY ACTUATING EQUIPMENT COMPRISING A BEAN-NEEDLE SYSTEM

[75] Inventors: Pierre Morin, Levallois Perret; Christian Bardin, Rueil Malmaison; Jean Boulet, Paris, all of France

[73] Assignee: Institut Francais du Petrole, Malmaison, France

[21] Appl. No.: 154,446

[22] Filed: Oct. 19, 1993

Related U.S. Application Data

[63] Continuation of Ser. No. 887,787, May 26, 1992, abandoned, which is a continuation of Ser. No. 459,284, Dec. 29, 1989, abandoned.

[30] Foreign Application Priority Data

Dec. 30, 1988 [FR] France ..... 88 17603

[51] Int. Cl.[6] ..... F15D 1/02

[52] U.S. Cl. ..... 138/46; 138/40; 138/45; 175/25; 175/38

[58] Field of Search ..... 138/40, 44, 45, 46; 175/25, 38

[56] References Cited

U.S. PATENT DOCUMENTS

| | | | |
|---|---|---|---|
| 2,879,032 | 3/1959 | Whittle | 175/25 |
| 2,963,099 | 12/1960 | Gianelloni | 175/25 |
| 3,203,184 | 8/1965 | Whittle et al. | 175/25 |
| 3,385,376 | 5/1968 | Hobhouse | 175/25 |
| 3,967,680 | 7/1976 | Jeter | 175/38 |
| 4,615,399 | 10/1986 | Schoeffler | 175/38 |
| 4,655,289 | 4/1987 | Schoeffler | 175/38 |
| 4,655,299 | 4/1987 | Schoeffler | 175/38 |
| 4,817,739 | 4/1989 | Jeter | 175/38 |
| 5,065,825 | 11/1991 | Bardin et al. | 175/38 |

FOREIGN PATENT DOCUMENTS

| | | | |
|---|---|---|---|
| 0630404 | 9/1978 | U.S.S.R. | 175/38 |
| 1028833 | 7/1983 | U.S.S.R. | 175/38 |

*Primary Examiner*—James E. Bryant, III

*Attorney, Agent, or Firm*—Antonelli, Terry, Stout & Kraus

[57] ABSTRACT

A device for remotely actuating a piece of equipment by varying the flow conditions of a fluid, possibly incompressible, an comprising an actuating piston, a nozzle-needle assembly. One of the nozzle or the needle is mounted for sliding movement into the piston. An arrangement is provided for returning the slidably mounted nozzle or needle to a predetermined position relatively to the piston.

6 Claims, 6 Drawing Sheets

DEVICE FOR REMOTELY ACTUATING EQUIPMENT COMPRISING A BEAN-NEEDLE SYSTEM

This is a continuation of application Ser. No. 887,787 filed May 20, 1992, now abandoned, which in turn was a continuation application of application Ser. No. 07/459,284 filed Dec. 29, 1989, now abandoned.

BACKGROUND OF THE INVENTION

1. Field of the Invention

The present invention relates to a device for remotely actuating equipment used in relation with pipes though which a fluid flows.

In the oil drilling field, it is often necessary to actuate tools in the drilled well from a distance.

The actuation of such tools requires high powers.

2. Description of the Prior Art

In the prior art, an annular piston was used with two faces and a restriction member comprising a bean system with variable flow section. One face of this piston is subjected to the pressure forces existing on one side of the restriction member, the other face is subjected to the pressure forces existing on the other side of the restriction member.

Generally, the bean is carried by the piston and the needle is fixed relatively to a pipe containing the assembly the piston being movable so as to effect the desired actuation. The piston comprises return means which hold it in an inoperative position corresponding to a relatively high flow section of the restriction member causing a low drop in pressure for service flowrates.

When it is desired to actuate the equipment, the flowrate is increased thereby increasing the pressure drop on each side of the restriction member so that the piston tends to move and runs counter to the return means. In this movement, the bean penetrates more and more into the needle causing a reduction of the flow section of the restriction member whence a greater increase of the drop in the pressure delivering the power for actuating the equipment.

The prior art may be illustrated by the patent FR-2 575 793.

A disadvantage of a device of the aforementioned type resides in the fact that the threshold flowrate is inaccurate thereby causing a tripping of the actuation. In fact, the assembly formed by the piston and the return spring, which must react to or transmit high powers, cannot respond accurately to a given flowrate threshold due to, for example, the friction forces.

SUMMARY OF THE INVENTION

The present invention overcomes the above noted disadvantages by using a bean system including a nozzle and a cooperable therewith, with the nozzle and needle being carried by the piston but movable with respect to the piston.

The bean or nozzle or the needle is of a small size with respect to the piston and equipped with appropriate return means which respond accurately to a flow rate threshold.

Thus, the present invention relates to a device for remotely actuating equipment by varying the flowrate conditions of a fluid, possibly incompressible fluid, comprising an actuating piston, and a bean or nozzle-needle assembly.

The present invention is characterized in that one of nozzle or the needle is mounted for sliding in the piston and in that the slidable nozzle or needle comprises means for returning the same to a pre-determined position with respect to the piston.

The element mounted for sliding in the piston may be either the nozzle or the needle.

The needle may be hollow and comprise apertures which cooperate with apertures carried by the bean.

The apertures may have a form adapted for progressively reducing the flow section of the fluid over a portion of the stroke of the needle.

BRIEF DESCRIPTION OF THE DRAWINGS

The present invention will be better understood and its advantages will be clear from the following description of particular exemplary embodiments with reference to the accompanying drawings in which.

DESCRIPTION OF THE PREFERRED EMBODIMENTS

Figure 1:
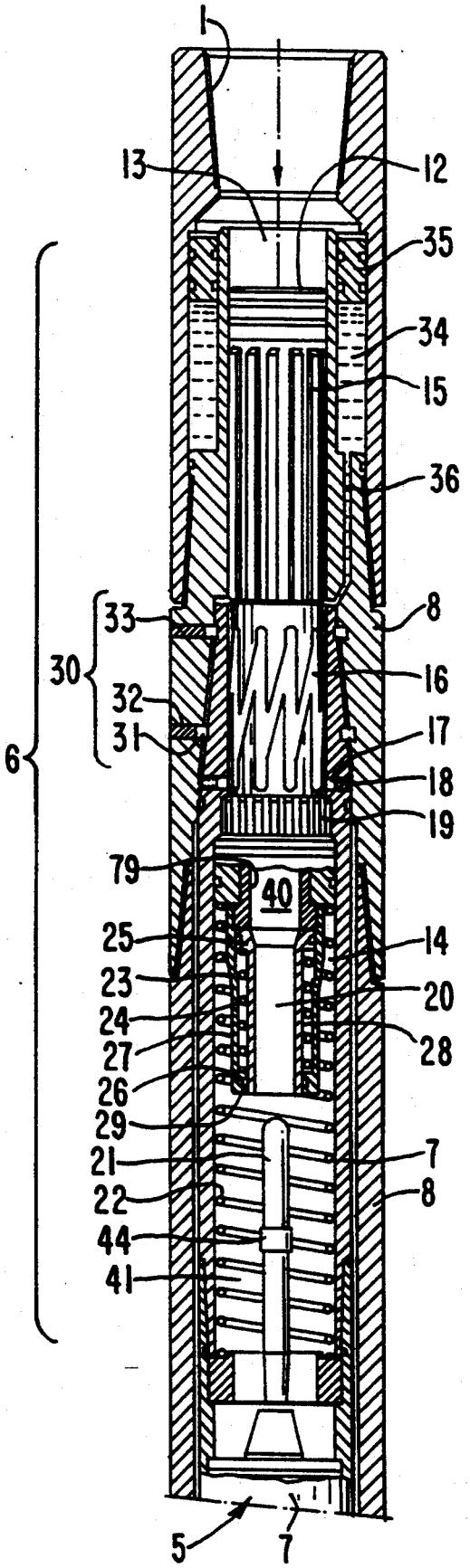
FIGS. 1, 1A and 1B are longitudinal cross-sectional views of one embodiment of a system constructed in accordance with the present invention.
Figure 1A:
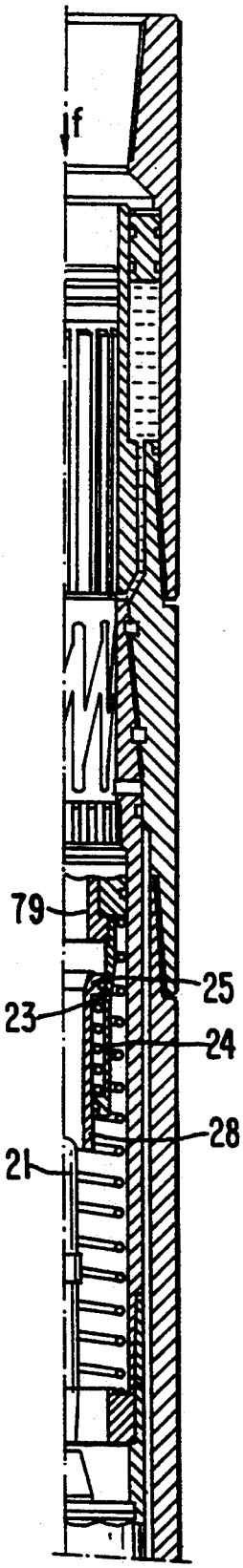
Figure 1B:
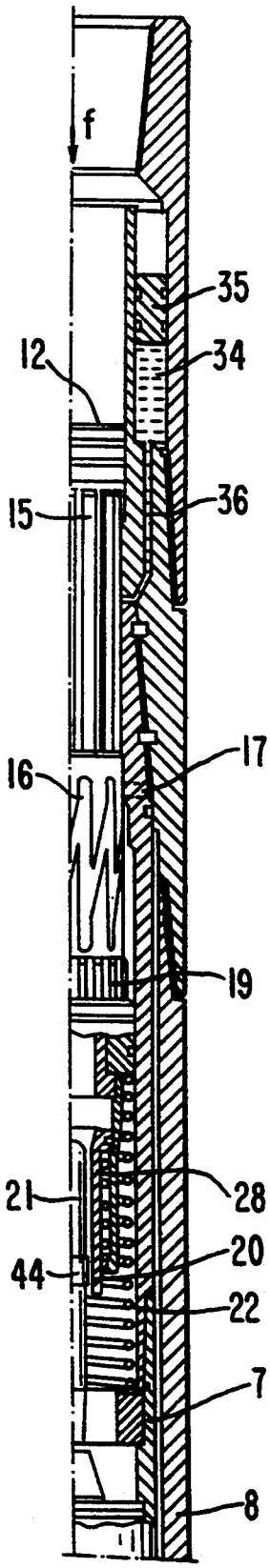
Figure 2:
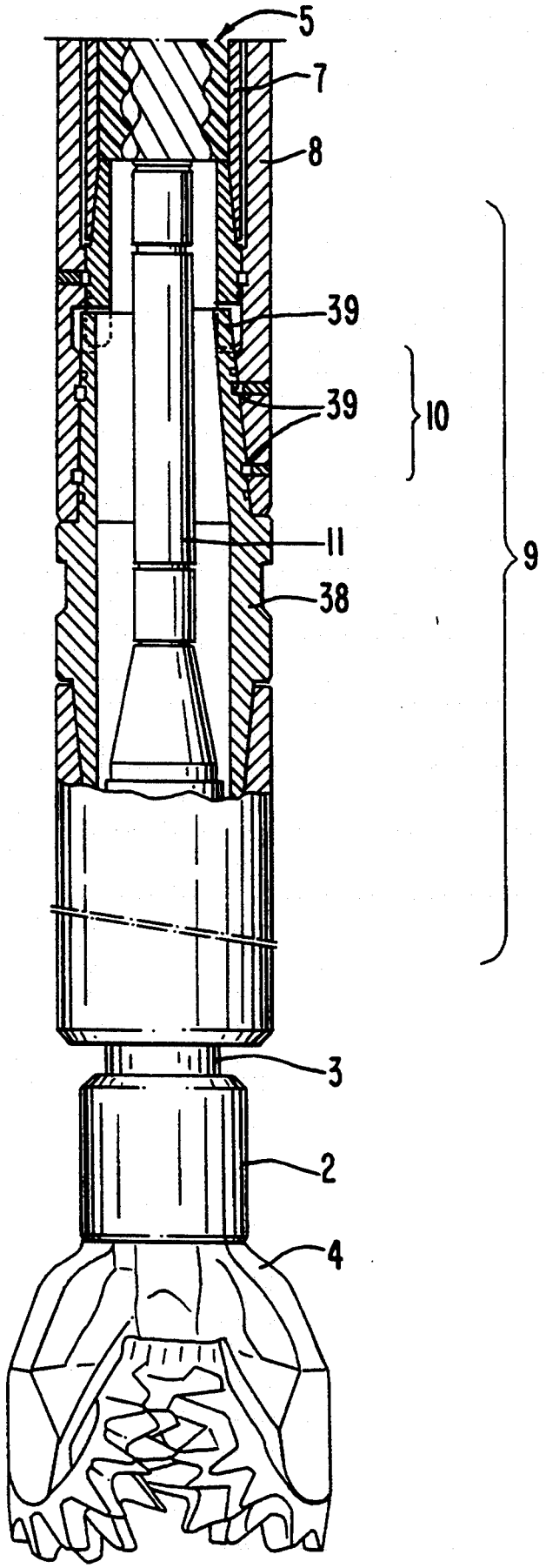
FIGS. 2 and 3 are partial cross-sectional schematic views of equipment to be actuated which include a variable angle elbow element.
Figure 3:
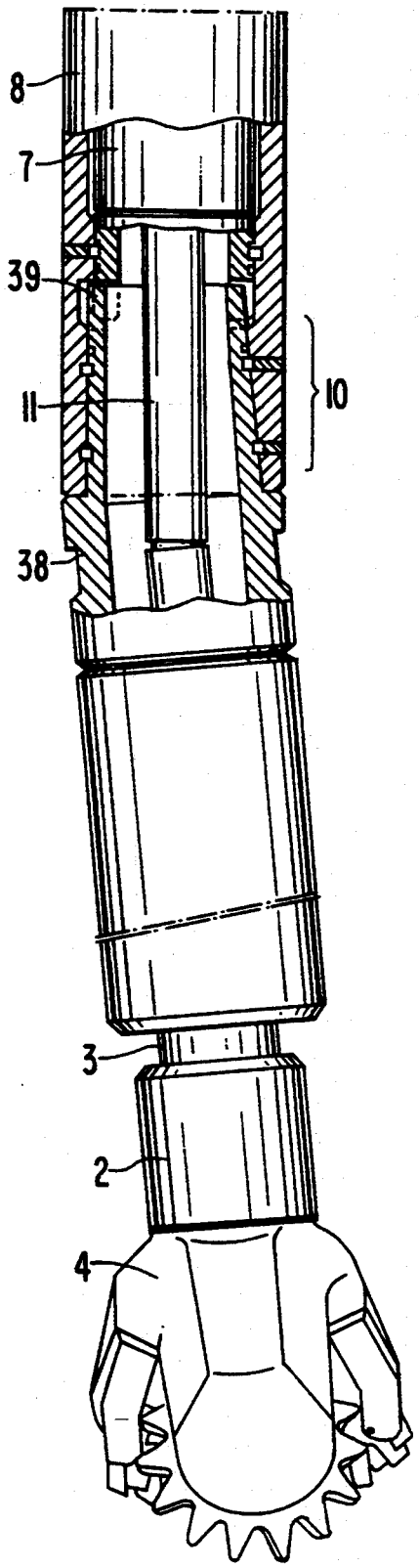

FIGS. 1, 2 and 3 show a particularly advantageous embodiment of a variable angle elbow wherein a tubular element comprises a threaded portion 1 at an upper portion thereof for mechanical connection with the drilling gear and part a threaded portion 2 on the output shaft 3 for threadably accomodated on a drilling tool 4.

The main functions of the drilling gear are provided by a bottom hole motor 5 (FIG. 2) which may, for example, be a multilobe volumetric motor of a Moineau type or any other type of bottom hole motor such as a volumetric or turbine bottom hole motor currently used for land drilling; a remote control mechanism 6 for sensing a change of position information and for causing a differential rotation of the tubular body 7 relative to the tubular body 8; a drive mechanism 9, absorbing axial and lateral forces, connecting the bottom hole motor 5 to the output shaft 3; and a mechanism 10 for varying the geometry based on a rotation of the tubular body 7. A universal joint 11 may be provided if the motor is of a Moineau type and/or when an elbow element 10 is used.

The remote control mechanism is formed of a shaft 12, forming a piston having an upper piston slidable in bore 13 of body 8 and a lower portion slidable in a bore 14 of a body 7. The shaft 12 comprises male spline portions 15 engaging in female spline portions of body 8, grooves 16 which are alternately straight (parallel to the axis of the tubular body) and oblique (slanted with respect to the axis of the tubular body 8) in which are engaged fingers 17 sliding along an axis perpendicular to the axis of movement of shaft 12 and held in contact with the shaft by springs 18, and male spline portions 19 meshing with female spline portions of body 7 only when the shaft 12 is in the top position.

Shaft 12 is equipped at the low portion thereof with a bean or nozzle 20 disposed in opposition to a coaxially disposed needle 21 which is coaxial to the shaft 12. A return spring 22 holds the shaft 12 in the top position, spline portions 19 meshing with the equivalent spline portions of body 7.

According to the present invention, bean or nozzle 20 is mounted for sliding in a housing 23 forming an integral part of shaft 12.

Bodies 7 and 8 are free to rotate at the level of the rotating bearing surface 30 coaxial with the axes of bodies 7 and 8 and formed of rows of cylindrical rollers 31 inserted in their running tracks and which can be removed through orifices 32 by removing door 33.

Bean or nozzle 20 and the needle 21 form means for detecting information, in this case a flowrate threshold. Shaft 12 with its arrangement forms the power means for actuating the mechanism 9 via the tubular body 7 which forms the transmission element.

An oil reserve 34 is held at the pressure of the drilling fluid via a free annular piston 35. The oil lubricates the sliding surfaces of shaft 12 via passage 36.

Shaft 12 is machined so that an axial bore 37 allows the drilling fluid to flow in the direction of arrow f.

A spring 24 holds the bean or nozzle 20 in a top position which corresponds to an inoperative position relative to the shaft 12. Spring 24 bears on a collar 25 integral with bean or nozzle 20 and on a shoulder 26 of shaft 12. In FIG. 1, the bean or nozzle 20 is guided by a bore 27 in which collar 25 slides as well as the circular body 28 of the bean or nozzle 20 which slides in the orifice 29.

The angle varying mechanism properly speaking which, in this embodiment is the member to be actuated comprises a tubular body 38 which is locked for rotation with tubular body 7 by a coupling 39. The tubular body 38 may rotate with respect to the tubular body 8 at the level of the rotating bearing surface 10 comprising rollers 39A and having an oblique axis with respect to the axes of the tubular bodies 8 and 38.

Figure 5:
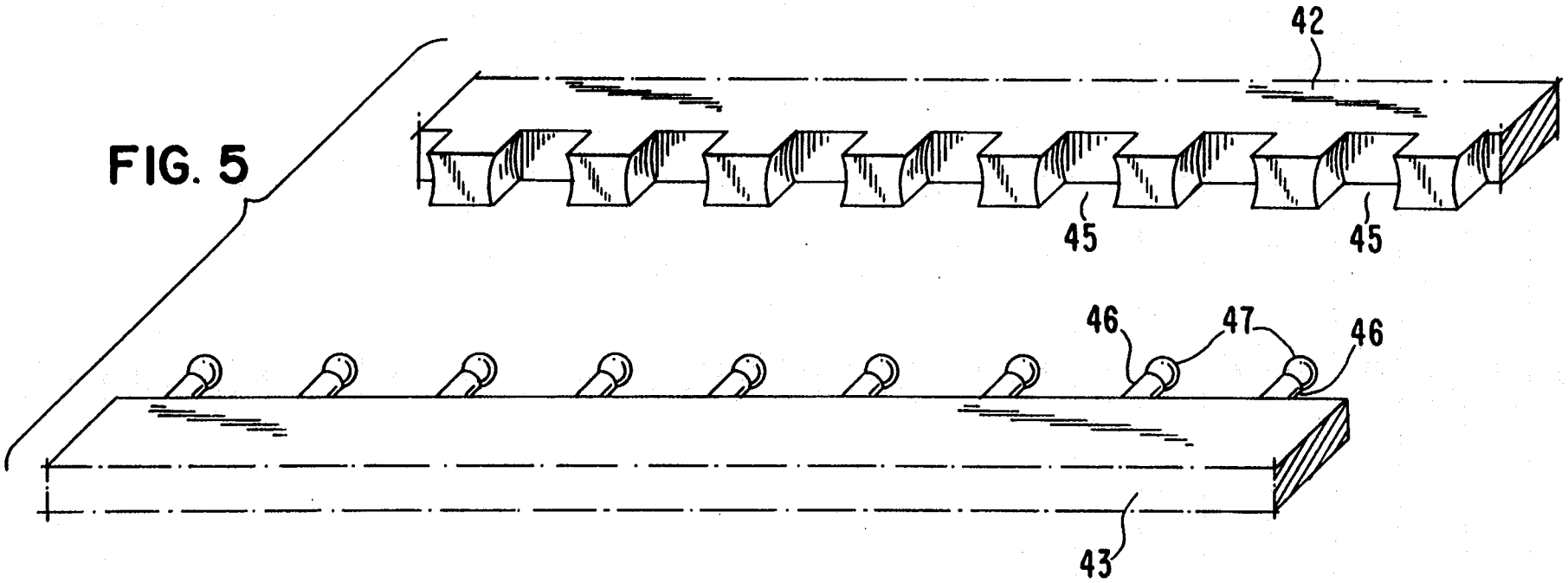
FIG. 5 is a perspective detail view of a drill stem driving system for flexing the drill stems.

One embodiment which may be considered for the coupling 39 is shown in FIG. 5.

The operation of the remote control mechanism is described hereafter. This type of remorse control is based on a threshold value of the flowrate passing through the mechanism in the direction of the arrow f.

When a flowrate Q passes through shaft 12, a pressure differential $\Delta P$ between the upstream portion 40 and the downstream portion 41 of the bean or nozzle 20. This pressure differential increases when the flowrate Q increases in accordance with the relationship $\Delta P = kQ^n$, where: is k a constant and n is a variable in a range of between 1.5 and 2 depending on the characteristics of the drilling fluid. This pressure differential $\Delta P$ is applied on the section S of bean or nozzle 20 and creates a force F tending to translate the bean or nozzle 20 in a downward direction and compresses the return spring 24. For a threshold value of the flowrate this force F will become sufficiently high to overcome the return force of the spring 24 and cause a translational movement of bean or nozzle 20. The calibration of spring 24 is adjusted as a function of the threshold flowrate value it is desired to obtain.

Because of this translational movement the bean or nozzle 20 will surround needle 21, which will greatly reduce the flow section of the drilling fluid, greatly increase the pressure difference $\Delta P$ and cause a great increase of force F' exerted on shaft 12 thereby causing complete downward movement of this shaft 12, despite the increase in the return force of spring 22 due to its compression and to the friction forces opposing its movement.

Figure 4:
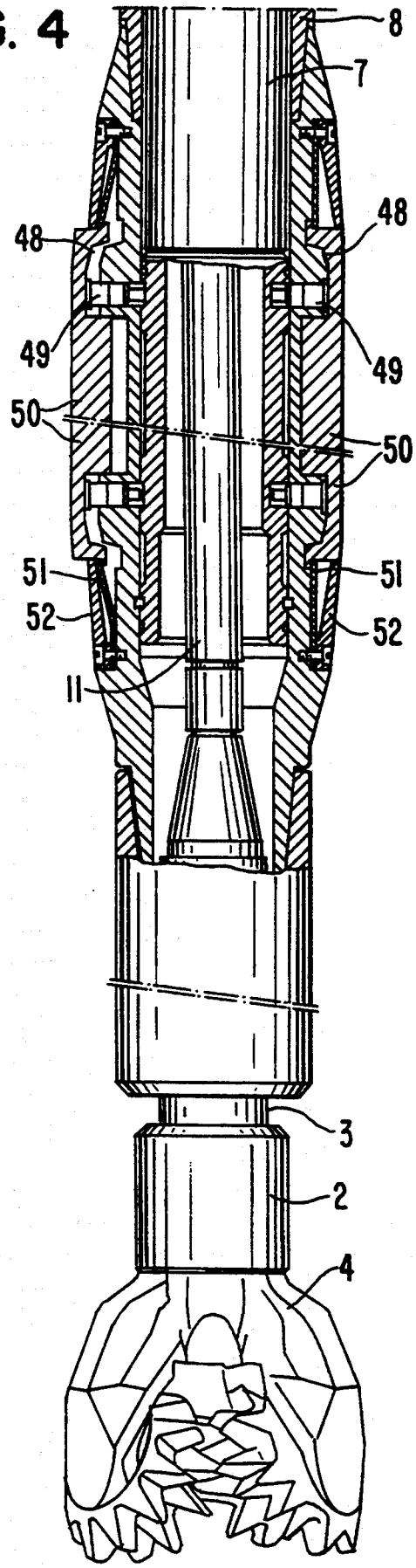
FIG. 4 is a partial cross-sectional schematic view of equipment to be actuated which includes a variable geometry stabilizer.

Thus, the movement alone of the mobile bean or nozzle 20, without movement of shaft 12, as illustrated in FIG. 3, accurately detects the threshold flowrate value and, consequently, causes an appreciable pressure loss resulting in the downward movement of shaft 12, as shown in FIG. 4. This downward movement of the shaft 12 actuates a piece of the equipment such as a variable angle elbow, and the mobile bean or nozzle 20 acts as it were like an electric relay.

Because of the machined shape of grooves 16 described in the patent FR-2 432 079, fingers 17 will follow the oblique portion of groove 16 during the downward stroke of shaft 12 and will therefore cause rotation of tubular body 7 with respect to tubular body 8, which is made impossible by the fact that the male spline portions 19 will be disengaged from the corresponding female spline portions of body 7 at the beginning of the downward stroke of shaft 12.

With the shaft in a low abutment position, the flow will be cut off thereby making it possible for the return spring 22 to push shaft 12 in an upward direction. The same goes for bean 20 which is pushed back upwards by the return spring 24.

During this upward travel, the finger 17 follows the rectilinear portions of the grooves 16. At the end of travel, the spline portions 19 will again be engaged so as to interlock the tubular bodies 7 and 8 for rotation.

In order to transmit information to the surface indicating that shaft 8 has reached its low position, the needle 21 may have a diameter variation. In FIG. 1, the needle 21 may be provided with an increased diameter portion 44. Thus, when the bean or nozzle 20 arrives at the level of increase diameter portion 44, there is a reduction of the fluid flow section which results in an overpressure in the drilling fluid for a constant flowrate.

This overpressure is detectable at the surface. The position of increased diameter portion 44 is such that the overpressure only appears when shaft 12 is at the low end of its travel.

The members 42 and 43 in FIG. 5 transmit the rotation of the tubular body 7 to the tubular body 38 while permitting a relative angular movement of these two tubular bodies 7, 38.

The member 42 comprises housings 45 in which are engaged pins 46 comprising spheres 47. Thus, although the tubular body integral with member 42 bends relatively to the tubular body integral with member 43, one tubular body drives the other in rotation. Thus, these two members 42, 43 play the same role as a hollow universal drive.

Variation of the angle is obtained by rotating the tubular body 7 relative to the tubular body 8, which causes, via the drive mechanism 39, rotation of the tubular body 38 with respect to the same tubular body 8. Since this rotation occurs about an axis which is oblique with respect to the two axes of the tubular bodies 8 and 38, it will cause a modification of the angle formed by the axes of bodies 8 and 38. This angle variation is described in detail in FR-2 432 079. FIG. 3 shows the same part of the device as that shown in FIG. 2, but in a geometrically different position.

An embodiment will now be described in which the member to be actuated is a variable geometry stabilizer. The remote control mechanism for this stabilizer is the same as that described above.

FIG. 4 shows the mechanism for varying the position of one or more blades of an integrated stabilizer. FIG. 4 may be considered as being the lower part of FIG. 1. At the lower end of body 7 are formed grooves 48 whose depth differs as a function of the angular sector concerned. At the bottom of these grooves are applied pushers 49 on which straight or helical blades 50 bear under the effect of blade return springs 51 positioned under protecting covers 52. The operation of the mechanism varying the position of one or more blades is described below.

When the tubular body 7 rotates with respect to the tubular body 8, caused by the movement of shaft 12, pushers 49 will be situated on a sector of groove 48 whose depth will be different. That will cause a translational movement of the blades, either away from or towards the axis of the body.

FIG. 4 shows on the right hand side a blade in the "retracted" position and on the left a blade in the "extended" position. Several intermediate positions may be envisaged, depending on the angular rotational pitch of the remote controlled rotation mechanism. It is the profile of the bottom of the groove 48 which controls the position of the blades. If three blades are controlled from the same groove and over a revolution, the profile is reproduced identically every 120° if movement of the three blades is to be identical.

Figure 6:
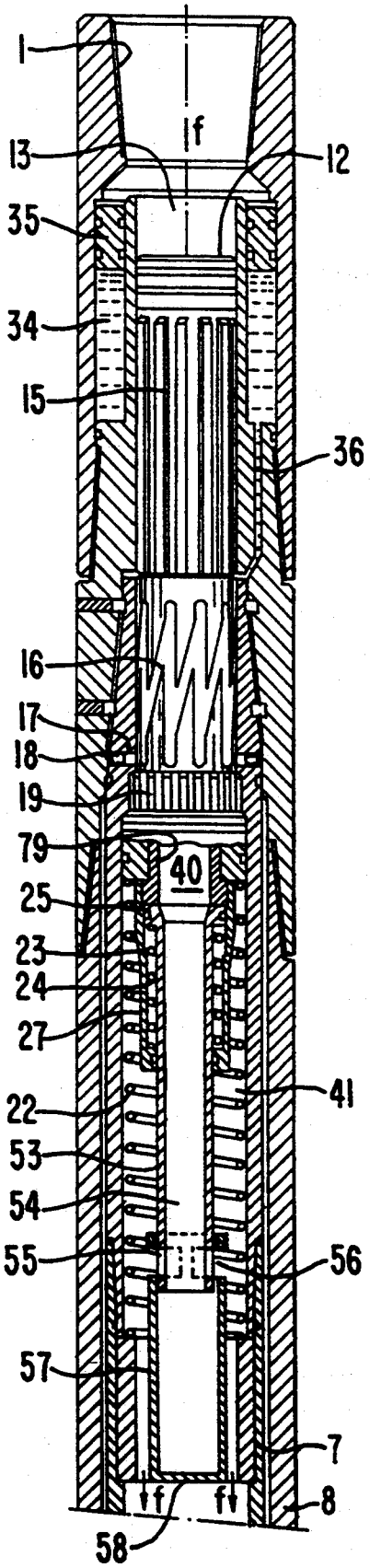
FIGS. 6, 6A and 6B are longitudinal cross-sectional views of another embodiment of the system of the present invention.
Figure 6A:
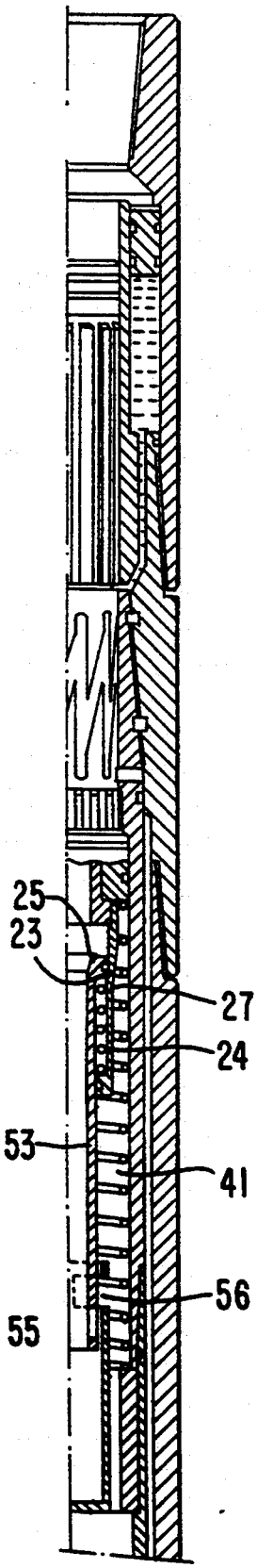
Figure 6B:
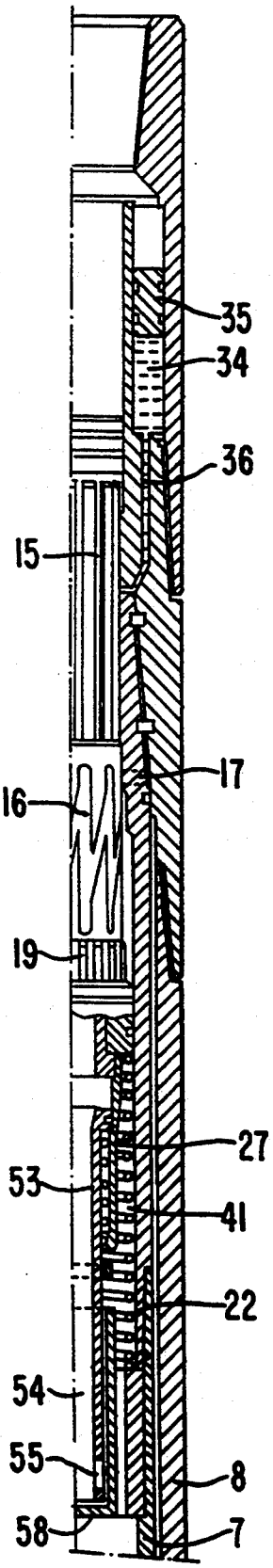

FIGS. 6, 6A and 6B correspond respectively to FIGS. 1,, 1A and 1B in so far as the position of shaft 12 and the state of the system are concerned.

However, in these FIGS. 6, 6A and 6B, the needle 53 is fast with shaft 12 and comprises a passage 54. This needle 53, which is therefore hollow, comprises apertures 55 which cooperate with apertures 56 formed in bean or nozzle 57 which is fast with the tubular body 7.

In FIG. 6, bean or nozzle 57 is cylindrical and comprises a closed bottom 58. Needle 53, which is also cylindrical, slides in bean or nozzle 57.

In the initial position, the apertures 55 of needle and 56 of bean or nozzle 57 are facing each other and the fluid flows in the direction of arrows f (FIG. 6).

When a pre-determined flowrate threshold is reached, the pressure difference between the upstream 40 and downstream 41 zone on each side of the system, increases, needle 53 included, spring 24 (FIG. 6) without there being yet movement of the piston 12.

Figure 8:
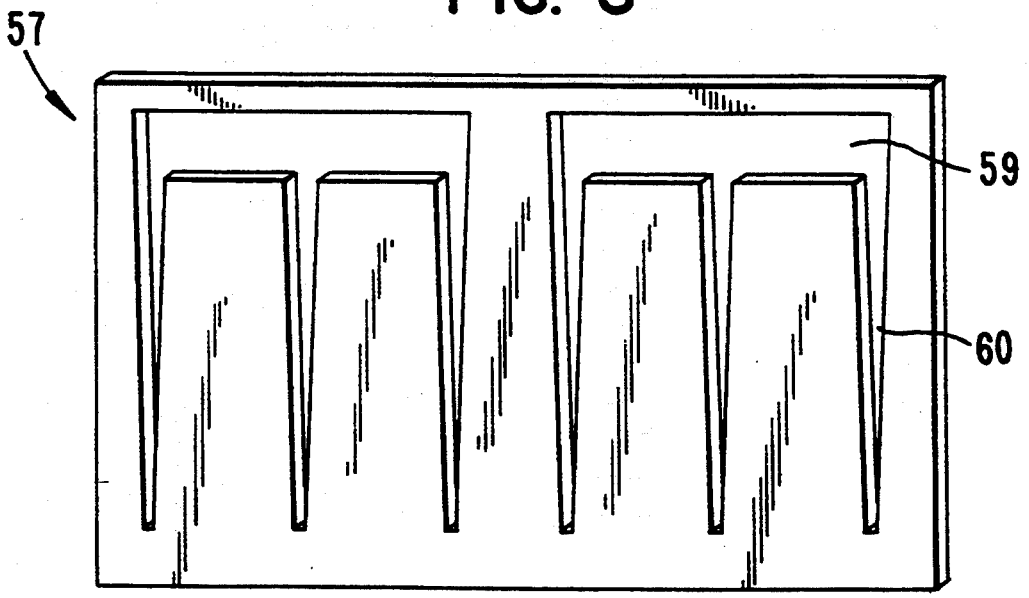

The flow section left for the fluid because of the cooperation of apertures 55 and 56 decreases and is limited to the clearance between the needle 53 and the bean or nozzle 57, this is the case of FIG. 6A. Thus, the pressure differential between the upstream 57 and 41 of piston 12 increases sufficiently to actuate piston 12 which moves down and occupies the position shown in FIG. 8.

During this downward movement, the piston 12 actuates the equipment to be controlled.

FIGS. 9 and 10 show, unfolded, particular forms of apertures 59 of bean 57. These forms provide a progression of the flow section left for the fluid when needle 53 moves in bean 57.

Figure 7:
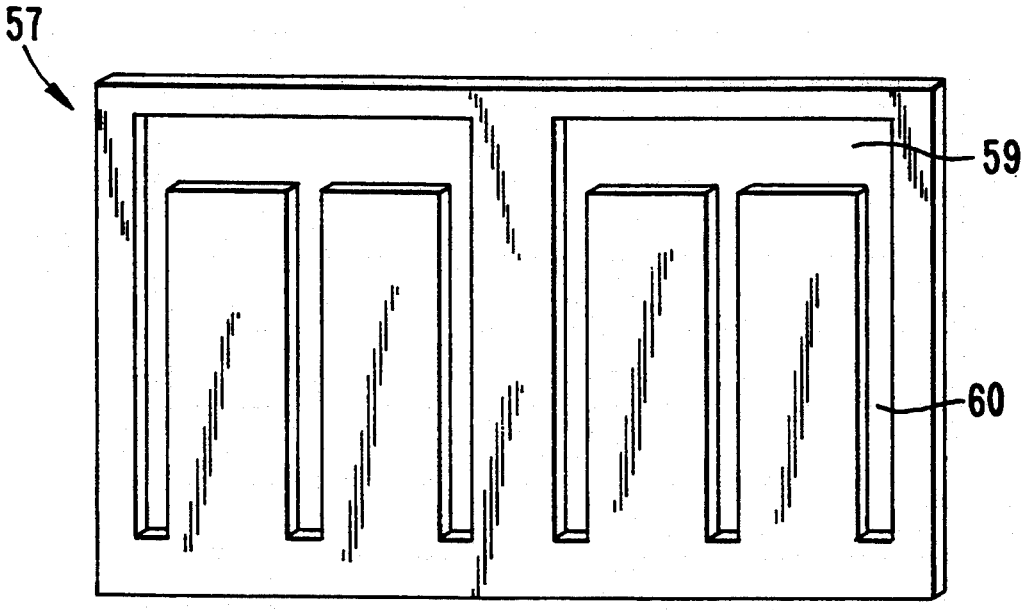
FIGS. 7 and 8 are detail views of a shape of apertures formed in the system of the present invention.

Of course, these apertures may have a special shape for indicating that shaft 12 has reached the end of its travel. This is obtained in the case of the aperture shown in FIG. 7 when aperture 55 assumed rectangular passes beyond the low part 60 of aperture 59 of bean 57. In this case, there is a sudden pressure variation which can be detected at the surface.

What is claimed is:

1. A device for varying a flow condition of a fluid so as to enable a remote actuation a piece of equipment, the device comprising an actuating piston for enabling an actuation of the piece of equipment and including a bore through which the fluid flows, a nozzle, communicating with the bore, which axially slides relative to the actuating piston, a needle, cooperable with the nozzle, which varies the flow conditions of the fluid supplied to the device through the bore and the nozzle in response to axial movement of the nozzle relative the needle and means for returning the slidably mounted nozzle to a predetermined position relative to the actuating piston, and wherein the nozzle and the needle are sized with respect to actuating piston such that the means for returning responds accurately to a flow rate threshold value for actuating the piece of equipment.

2. A device according to claim 1, wherein the fluid is a drilling fluid.

3. A device for varying a flow condition of a fluid so as to enable a remote actuation a piece of equipment, the device comprising first means for enabling an actuation of the piece of equipment and including a bore through which the fluid flows, second means, communicating with the bore, for axially sliding relative to the first means, a third means, cooperable with the second means, for varying the flow conditions of the fluid supplied to the device through the bore and the second means in response to axial movement of the second means relative the third means and fourth means for returning the second means to a predetermined position relative to the first means and wherein the second means and the third means are sized with respect to the first means such that the fourth means responds accurately to a flow rate threshold value for actuating the piece of equipment.

4. A device according to claim 3 wherein:
the first means is an actuating piston;
the second means is a nozzle;
the third means is a needle; and
the fourth means comprises a spring.

5. A device in accordance with claim 3 wherein: the fluid is a drilling fluid.

6. A device in accordance with claim 4 wherein: the fluid is a drilling fluid.

* * * * *